US009503808B2

(12) United States Patent
Akino

(10) Patent No.: US 9,503,808 B2
(45) Date of Patent: Nov. 22, 2016

(54) BOUNDARY MICROPHONE AND BOUNDARY MICROPHONE ADAPTER

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/809,864

(22) Filed: Jul. 27, 2015

(65) Prior Publication Data

US 2016/0044408 A1 Feb. 11, 2016

(30) Foreign Application Priority Data

Aug. 5, 2014 (JP) ..... 2014-159372

(51) Int. Cl.
*H04R 1/32* (2006.01)
*H04R 1/34* (2006.01)

(52) U.S. Cl.
CPC ..... *H04R 1/342* (2013.01)

(58) Field of Classification Search
CPC ..... H04R 5/027; H04R 1/326
See application file for complete search history.

(56) References Cited

U.S. PATENT DOCUMENTS 6,711,272 B2 * 3/2004 Rodgers ..... F16M 11/04 381/361
7,007,901 B2 * 3/2006 Kondo ..... F16M 11/14 248/288.51
7,136,499 B2 * 11/2006 Kondo ..... H04R 1/2892 381/355
2013/0039523 A1 * 2/2013 Van Dijk ..... H04R 1/342 381/356

FOREIGN PATENT DOCUMENTS

JP H08-65786 A 3/1996
JP 2013-527995 A 7/2013

* cited by examiner

*Primary Examiner* — Brenda Bernardi
(74) *Attorney, Agent, or Firm* — Manabu Kanesaka

(57) ABSTRACT

A boundary microphone that can reduce the change in its directional property caused by change of a sound collection axis of a microphone unit is provided. The boundary microphone includes a unidirectional microphone unit, a cylindrical unit holding member having a unit accommodating pocket in its peripheral surface to accommodate the unidirectional microphone unit, and a boundary plate to which top face the unit holding member is attached so as to rotate about its axis. When the unidirectional microphone unit is held in the unit holding member, a front acoustic terminal is positioned to face the outside of the peripheral surface of the unit holding member, the sound collection axis intersects the axis of a hollow of the unit holding member, and a rear acoustic terminal communicates with the outside at both side ends of the hollow via the hollow of the unit holding member.

8 Claims, 14 Drawing Sheets

BOUNDARY MICROPHONE AND BOUNDARY MICROPHONE ADAPTER

RELATED APPLICATIONS

The present application is based on, and claims priority from, Japanese Application No. JP2014-159372 filed Aug. 5, 2014, the disclosure of which is hereby incorporated by reference herein in its entirety.

BACKGROUND OF THE INVENTION

1. Field of the Invention

The present invention relates to a boundary microphone and a boundary microphone adapter capable of changing a sound collection axis of a microphone relative to a boundary plate.

2. Description of the Related Art

A boundary microphone (on-surface sound pickup microphone) is usually used in a conference room or a broadcast studio.

The boundary microphone is placed on a table when used in a conference room and placed mainly on the floor when used in a broadcast studio.

As disclosed, for example, in JP H8-65786 A and JP 2013-527995 W, the boundary microphone is configured with a boundary plate and a microphone held on the boundary plate.

In this configuration, the microphone is disposed close to the boundary plate, so that the microphone receives direct sound and reflected sound from the boundary plate. Since the direct sound and the reflected sound from the boundary plate have almost no time-gap (phase difference), a clear high acoustic signal can be obtained.

In the boundary microphone, for example, the sound collection axis of a unidirectional microphone is usually fixed parallel with the top face of the boundary plate.

Thus when a sound source is not on the sound collection axis of the boundary microphone, it is difficult to collect sound with good quality.

For example, if the boundary microphone is used in a conference room, the frequency response property of the boundary microphone placed on a table varies significantly between conditions when a speaker is sitting and when a speaker is standing.

Regarding such problem, a configuration may be employed in which the microphone unit is attached to the boundary plate with changeable elevation angle of the sound collection axis of a unidirectional microphone unit. In such a configuration, the sound collection axis of the microphone unit can suitably be adjusted toward a sound source, and deterioration in frequency response property caused by the deviation of the sound collection axis from the sound source can be prevented.

Meanwhile, when the sound collection axis of a microphone unit placed on the boundary plate is turned, the directional property of the microphone unit disadvantageously changes as explained below.

FIGS. 5A to 5C illustrate an external configuration of a unidirectional electric condenser microphone unit 1 used as a boundary microphone. FIGS. 5A to 5C are respectively a front view, a side view, and a rear view of the microphone unit 1.

As illustrated in the FIGS. 5A to 5C, the unidirectional electric condenser microphone unit 1 includes a cylindrical unit case 2 made of, for example, aluminum including an outer case, and as illustrated in FIG. 5A, a plurality of openings 3 serving as a front acoustic terminal of the microphone unit 1 provided in the front face of the unit case 2.

As well known, a diaphragm and a fixed pole facing the rear side of the diaphragm are disposed in the unit case 2, although not illustrated in the drawings. A circuit board 4 having an FET that functions as an impedance converter mounted thereon is attached to the rear side of the unit case 2 so as to seal the unit case 2 as illustrated in FIG. 5C.

The circuit board 4 is provided with a plurality of openings 5 which serve as a rear acoustic terminal of the microphone unit.

The microphone unit 1 is attached to the boundary plate 21 as illustrated in FIG. 6A. The microphone unit 1 is attached to the boundary plate 21 in a suitable configuration capable of changing the direction of sound collection axis D relative to the boundary plate 21 from the direction parallel with the top face of the boundary plate 21, or an elevation angle of 0 degree, to the vertical direction, or an elevation angle of 90 degrees.

FIG. 6B illustrates the microphone unit 1 in an attitude where the sound collection axis D is at an elevation angle of approximately 45 degrees. In this attitude, compared with an attitude where the sound collection axis D is at an elevation angle of 0 degree as illustrated in FIG. 6A, the rear acoustic terminal of the microphone unit 1 is positioned close to the boundary plate 21 and the gap between the rear acoustic terminal and the boundary plate 21 is narrow.

When the sound collection axis D is further turned toward the vertical direction, increasing the elevation angle, the gap between the rear acoustic terminal and the boundary plate 21 is further narrowed.

Along with the change in the elevation angle of the sound collection axis D of the microphone unit 1, signal waves traveling toward the rear acoustic terminal is further limited. The microphone unit thereby changes its characteristics from unidirectional characteristics to characteristics close to omnidirectional. When this change is significant, a problem such as howling arises.

SUMMARY OF THE INVENTION

The present invention is made in view of the aforementioned technical problem. The object of the present invention is to provide a boundary microphone and a boundary microphone adapter configured to avoid change in the effect of sound waves traveling toward the rear acoustic terminal of the microphone unit caused by change of a sound collection axis relative to the boundary plate so that the change in directional property of the microphone unit can be suppressed significantly.

To solve the aforementioned problem, a boundary microphone is provided that includes a unidirectional microphone, a unit holding member formed in a cylindrical shape having a unit accommodating pocket in a peripheral surface thereof to accommodate the unidirectional microphone unit, and a boundary plate to which the unit holding member is attached so that an axis of a hollow of the unit holding member is parallel with a top face of the boundary plate and the unit holding member rotates about the axis. The unidirectional microphone unit held in the unit holding member includes a front acoustic terminal facing outside of the peripheral surface of the unit holding member, a sound collection axis intersecting the axis of the hollow of the unit holding member, and a rear acoustic terminal communicating with outside at both side ends of the hollow via the hollow of unit holding member.

In a preferable embodiment, the unit accommodating pocket provided in the unit holding member has a through hole extending from the peripheral surface of the unit holding member toward the axis of the hollow, and an abutment for locking a rear end of the microphone unit to position the microphone unit inserted in the unit accommodating pocket.

Further, it is preferable that an inner space of the hollow of the unit holding member is partially enlarged to form a bore continuing to the abutment that positions the microphone unit.

The boundary microphone is further configured that the unit holding member formed in a cylindrical shape is rotatably attached to the boundary plate by a supporting frame member disposed along the peripheral surface of the unit holding member.

In a preferable embodiment, the boundary microphone further includes a supporting part including a pair of the supporting frame members each having a ring shape and attached to both axial ends of the unit holding member along the peripheral surface of the unit holding member, and a pair of base plates for fixing the supporting frame members on the boundary plate. With the axial ends of the unit holding member sandwiched by the pair of supporting frame members which are fixed on the boundary plate using the base plates, the unit holding member is attached so as to rotate above the boundary plate.

Furthermore, to solve the aforementioned problem, a boundary microphone adapter according to the embodiment includes a unit holding member formed in a cylindrical shape having a unit accommodating pocket in a peripheral surface thereof to accommodate a unidirectional microphone unit, and a boundary plate to which the unit holding member is attached so that an axis of a hollow of the unit holding member is parallel with the top face of the boundary plate and the unit holding member rotates about the axis. When a unidirectional microphone is attached to the unit holding member using the unit accommodating pocket, a front acoustic terminal is formed to face outside of the peripheral surface of the unit holding member, a sound collection axis intersects the axis of the hollow of the unit holding member, and a rear acoustic terminal communicates with outside at both side ends of the hollow via the hollow of the unit holding member.

The boundary microphone adapter is also configured that the unit accommodating pocket provided in the unit holding member has a through hole extending from the peripheral surface of the unit holding member toward the axis of the hollow, and an abutment for locking a rear end of the microphone unit to position the microphone unit inserted in the unit accommodating pocket.

According to the boundary microphone and the boundary microphone adapter configured as described above, the sound collection axis of the microphone unit held in the unit holding member can be changed by rotating the unit holding member provided above the boundary plate about its axis.

When the sound collection axis of the microphone unit is changed, the unit holding member rotates about the axis of its hollow, so that the attitude and the shape of the hollow communicating with the rear acoustic terminal of the microphone unit stays unchanged.

Therefore, the positional relationship between the rear acoustic terminal of the microphone unit and the boundary plate stays unchanged. This effectively prevents the change in directional property of the microphone unit.

As a result, a boundary microphone and a boundary microphone adapter that avoids the effect on the directional frequency response caused by change of the sound collection axis of the microphone unit can be provided.

DESCRIPTION OF THE PREFERRED EMBODIMENTS

Figure 1:
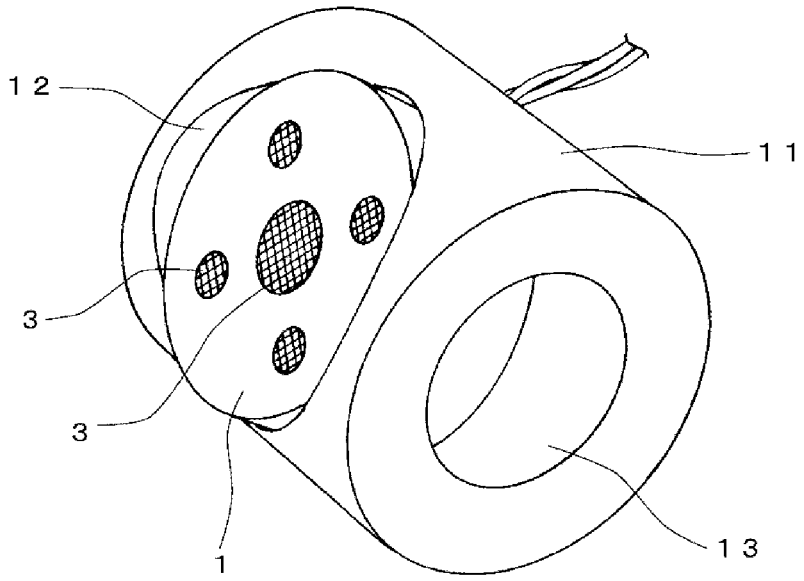
FIG. 1 is a perspective view of a microphone unit held in a unit holding member.

A boundary microphone and a boundary microphone adapter according to an embodiment of the present invention will be described referring to the drawings.

FIG. 1 and FIGS . 2A to 2C illustrate a boundary microphone configured with a cylindrical unit holding member 11 and a unidirectional microphone unit 1 attached to the unit holding member 11.

Figure 5A:
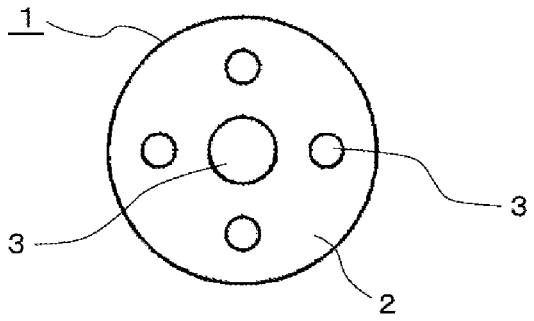
FIG. 5A is a front view of an example of a microphone unit used in the boundary microphone.
Figure 5B:
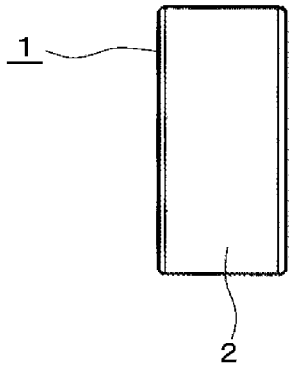
FIG. 5B is a side view of the same.
Figure 5C:
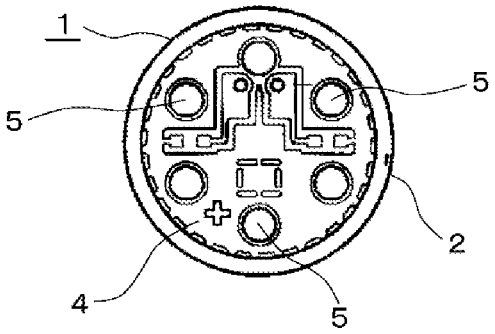
FIG. 5C is a rear view of the same.
Figure 6A:
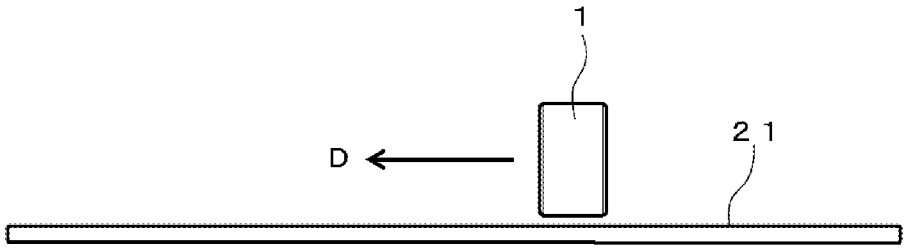
Fig. 6A Prior Art
FIG. 6A is a side view illustrating a basic configuration of a conventional boundary microphone.
Figure 6B:
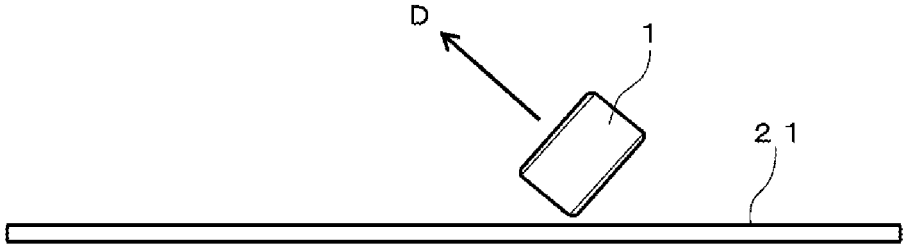
Fig. 6B Prior Art
FIG. 6B is a side view illustrating the same with its sound collection axis changed.

The unidirectional microphone 1 used in the embodiment is the same as the unidirectional electric condenser microphone unit 1 already explained referring to FIGS. 5A to 5C, so that its detail description is omitted.

The unit holding member 11 is formed in a cylindrical shape having a relatively thick wall. A unit accommodating pocket 12 to accommodate the microphone unit 1 is provided in the peripheral surface of the unit holding member 11.

The unit accommodating pocket 12 is a through hole with a circular cross section penetrating the peripheral surface of the unit holding member 11 into a hollow 13 provided about the axis of the unit holding member 11. An abutment 14 (see FIG. 2C) is provided at the bottom of the through hole for locking the rear end of the microphone unit 1 inserted in the unit accommodating pocket 12, thereby positioning the microphone unit 1.

Figure 2A:
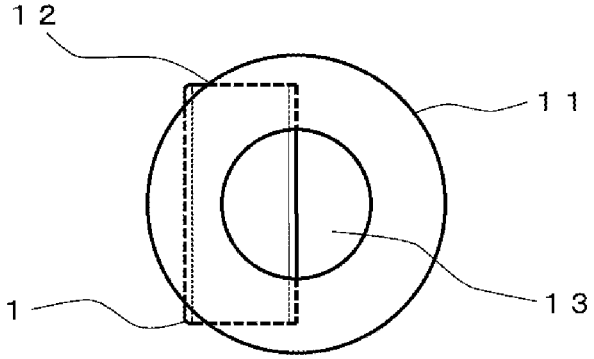
FIG. 2A is a side view of the same.
Figure 2B:
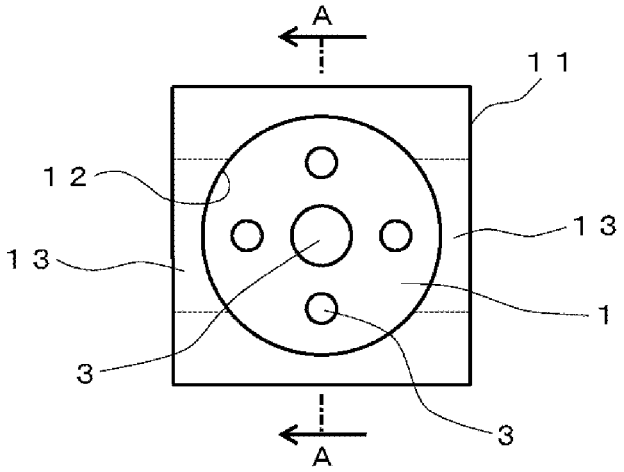
FIG. 2B is a front view of the same.
Figure 2C:
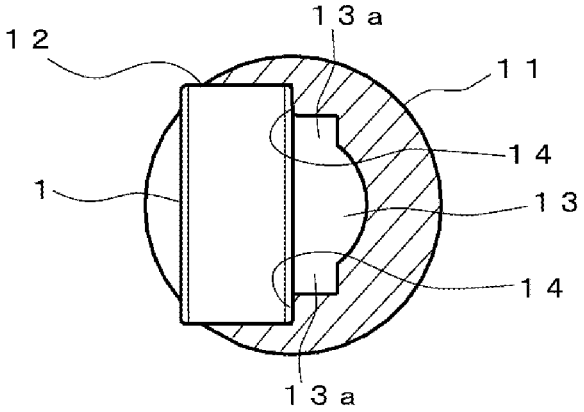
FIG. 2C is a sectional view taken along the line A-A viewed in the direction of the arrows in FIG. 2B.

As illustrated in FIG. 2C, the inner space of the hollow 13 is partially enlarged to form a bore 13*a* continuing to the abutment 14 that positions the microphone unit 1.

The bore 13*a* is provided to avoid the abutment 14 blocking a plurality of openings 5 which serve as a rear acoustic terminal of the microphone unit 1 accommodated in the unit accommodating pocket 12.

In this configuration, when the microphone unit 1 is accommodated in the unit accommodating pocket 12, the opening 3 serving as a front acoustic terminal of the microphone unit 1 is positioned to face the outside of the peripheral surface of the unit holding member 11 and the sound collection axis D of the microphone unit 1 intersects the axis of the hollow 13 of the unit holding member 11.

The openings 5, serving as the rear acoustic terminal of the microphone unit 1, provided in the circuit board 4 now communicate with the outside of the hollow 13 at both side ends of the hollow 13 via the hollow 13 of the unit holding member 11.

Figure 3A:
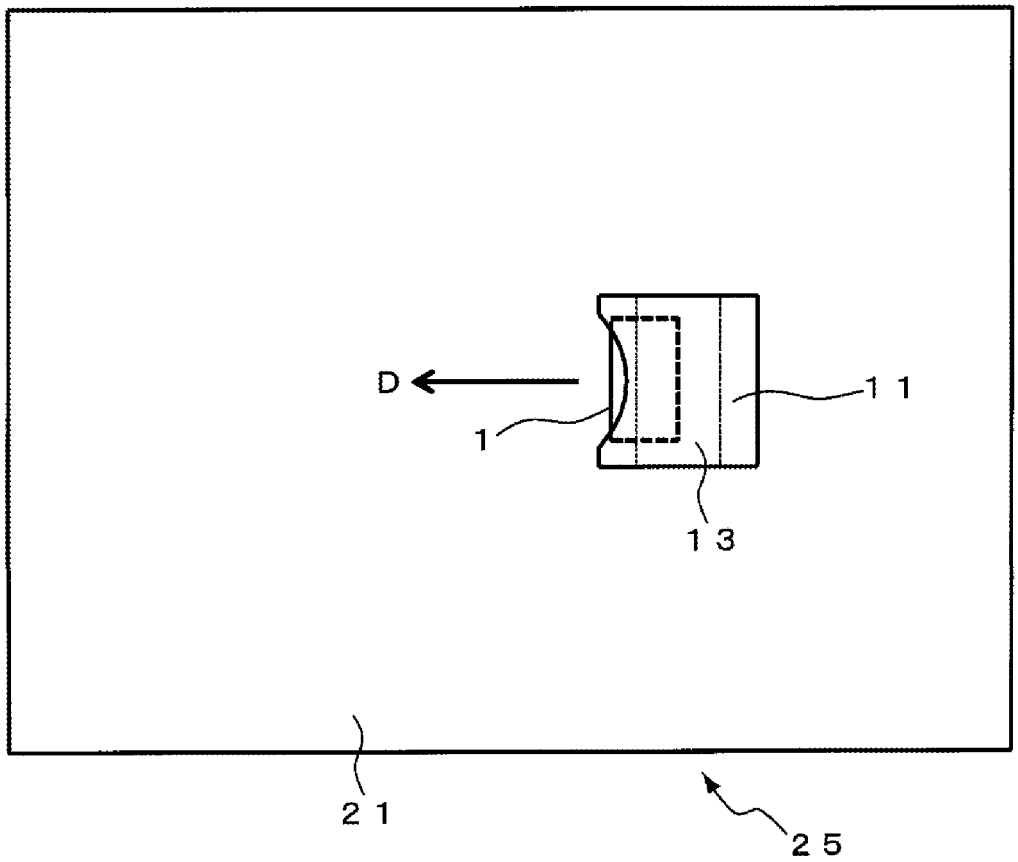
FIG. 3A is a plan view of a boundary microphone according to the embodiment.
Figure 3B:
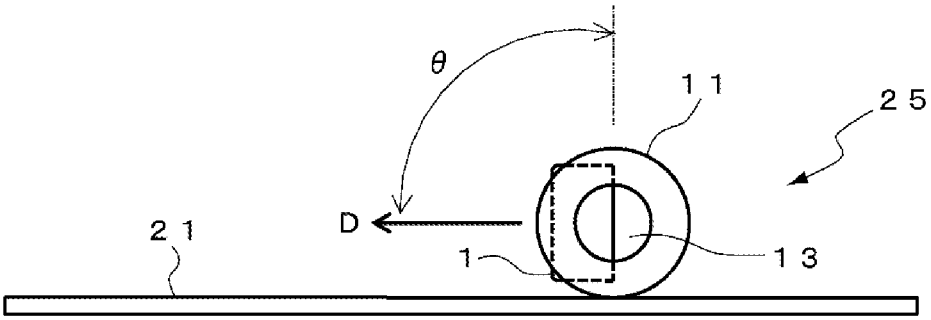
FIG. 3B is a side view of the same.

As illustrated in FIGS. 3A and 3B, the cylindrical unit holding member 11 holding the microphone unit 1 is attached to the boundary plate 21 to constitute a boundary microphone 25.

The unit holding member 11 is attached to the boundary plate 21 so as to rotate about the axis of the unit holding member 11. The microphone unit 1 held in the unit holding member 11 can rotate within a range indicated by arrow 6, that is, from the attitude where the sound collection axis D is parallel with the top face of the boundary plate 21, or an elevation angle of 0 degree, to the attitude where the sound collection axis D is vertical, or an elevation angle of 90 degrees.

Figure 4:
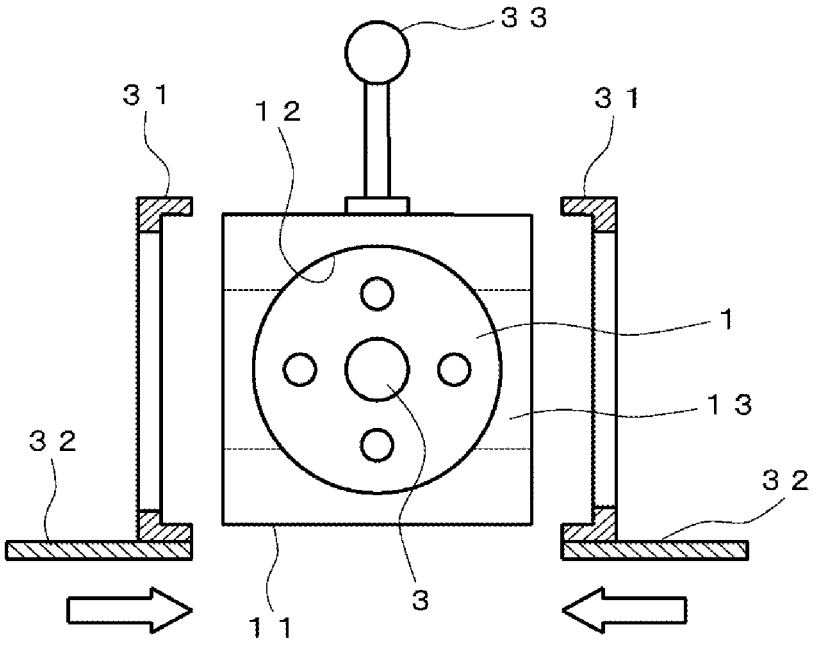
FIG. 4 is a schematic view illustrating an example configuration for rotatably supporting the unit holding member.

FIG. 4 illustrates an example of a supporting part for rotatably supporting the unit holding member 11 on the boundary plate 21. In FIG. 4, the longitudinal-sectional view of the supporting part is illustrated.

The supporting part is configured with a pair of ring-shaped supporting frame members 31 attached to both axial ends of the unit holding member 11 along the peripheral surface of the unit holding member 11, and a pair of base plates 32 used for fixing the supporting frame members 31 on the boundary plate 21.

With the axial ends of the unit holding member 11 sandwiched by the pair of supporting frame members 31 which are fixed on the boundary plate 21 using the base plates 32, the unit holding member 11 is attached so as to rotate above the boundary plate 21.

A rod handle 33 is attached to the side surface of the unit holding member 11 as illustrated in FIG. 4. The unit holding member 11 can be turned about its axis using the handle 33 to adjust the elevation angle θ of the sound collection axis D of the microphone unit 1 held in the unit holding member 11 without difficulty.

With this configuration, the boundary microphone 25 allows the microphone unit 1 held in the cylindrical unit holding member 11 to rotate about the axis. So that even when the elevation angle θ of the sound collection axis D of the microphone unit 1 changes, the attitude and the shape of the hollow 13 communicating with the rear acoustic terminal of the microphone unit 1 stays unchanged.

Even when the sound collection axis D of the microphone unit 1 changes, the positional relationship between the rear acoustic terminal of the microphone unit 1 and the boundary plate 21 stays unchanged, so that the change in directional property of the microphone unit 1 can significantly be suppressed.

FIGS. 7A to 7H illustrate directional frequency response properties and polar patterns of the boundary microphone according to the embodiment for different elevation angles θ of the sound collection axis D. FIGS. 8A to 8H illustrate directional frequency response properties and polar patterns of a conventional boundary microphone for different elevation angles θ of the sound collection axis D obtained in a similar manner.

Figure 7A:
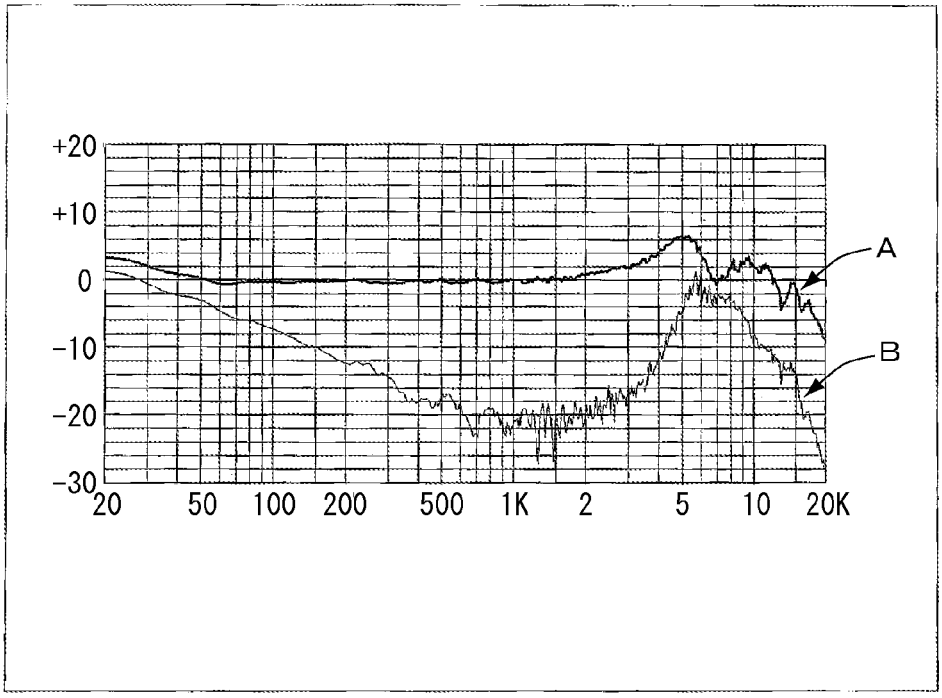
FIG. 7A is a directional frequency response property chart of a boundary microphone according to the embodiment when an elevation angle of a sound collection axis is 0 degree.
Figure 7B:
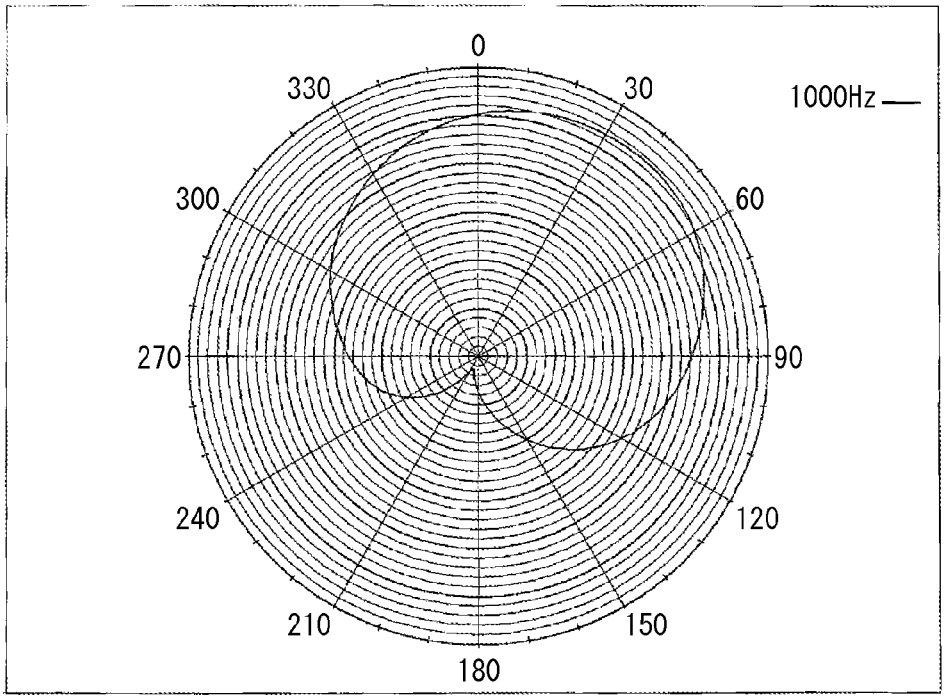
FIG. 7B is a polar pattern of the same.
Figure 8A:
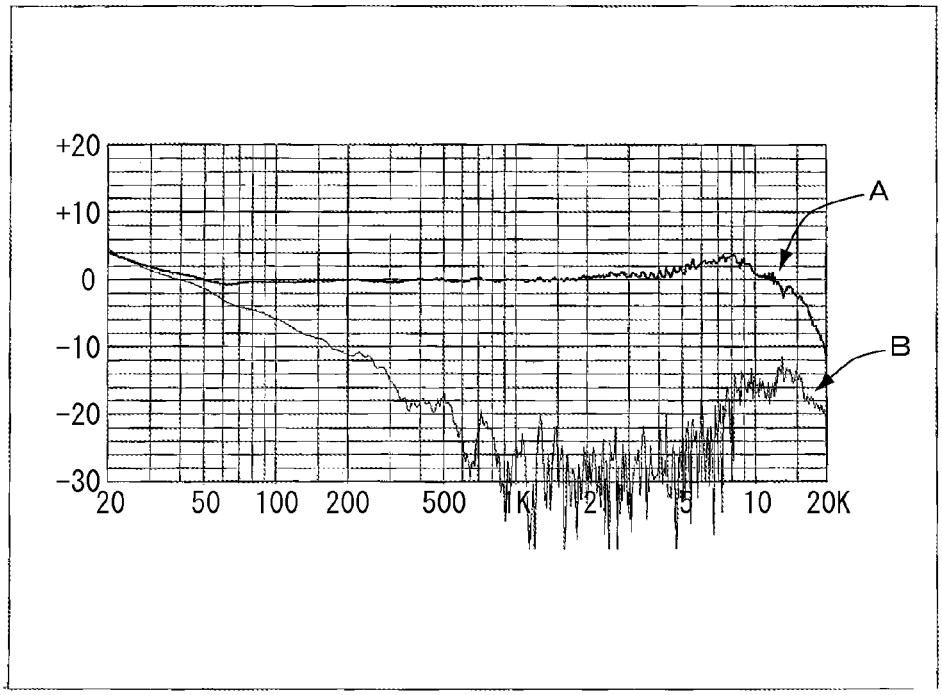
Fig. 8A Prior Art
FIG. 8A is a directional frequency response property chart of a conventional boundary microphone when the elevation angle of the sound collection axis is 0 degree.
Figure 8B:
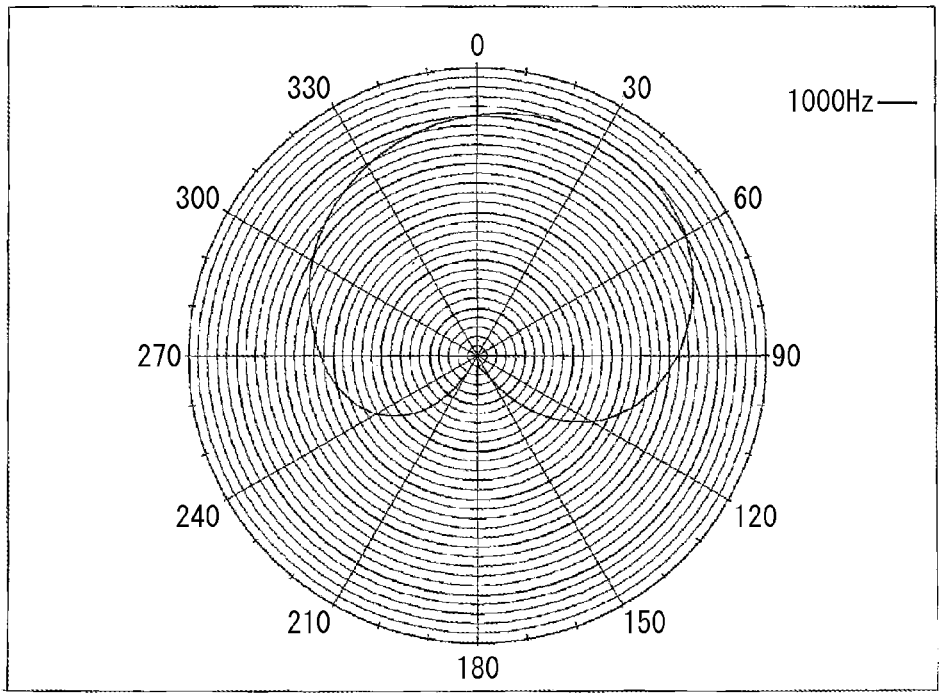
Fig. 8B Prior Art
FIG. 8B is a polar pattern of the same.

In FIGS. 7A and 8A, reference signs A and B indicate properties of 0 degree and 180 degrees of the angle to the sound source, respectively, where the elevation angle θ of the sound collection axis D is 0 degree.

Figure 7C:
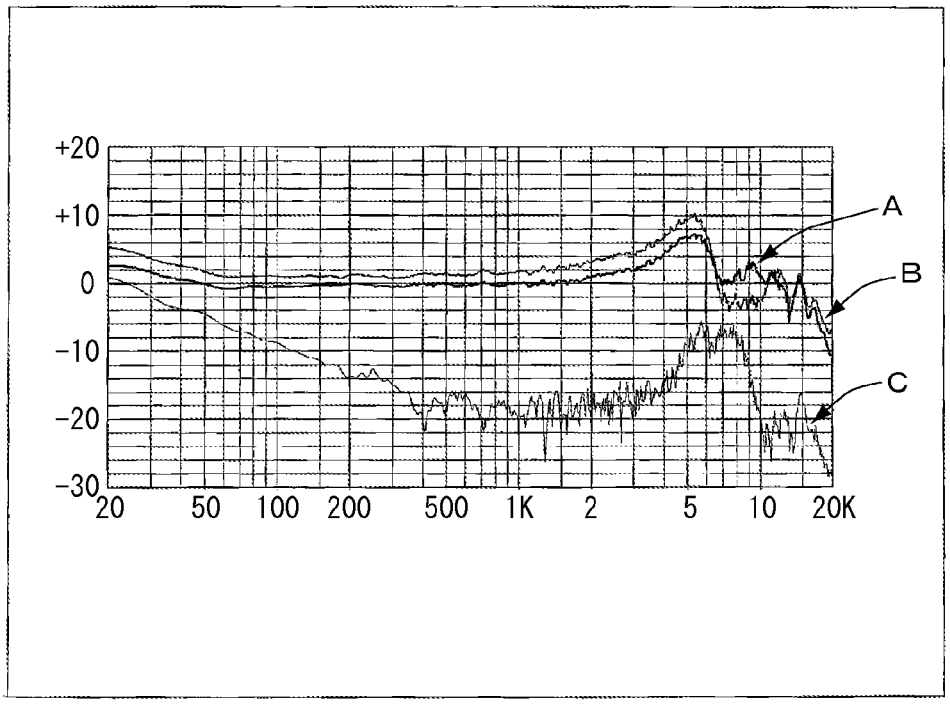
FIG. 7C is a directional frequency response property chart of the boundary microphone when the elevation angle of the sound collection axis is 30 degrees.
Figure 7D:
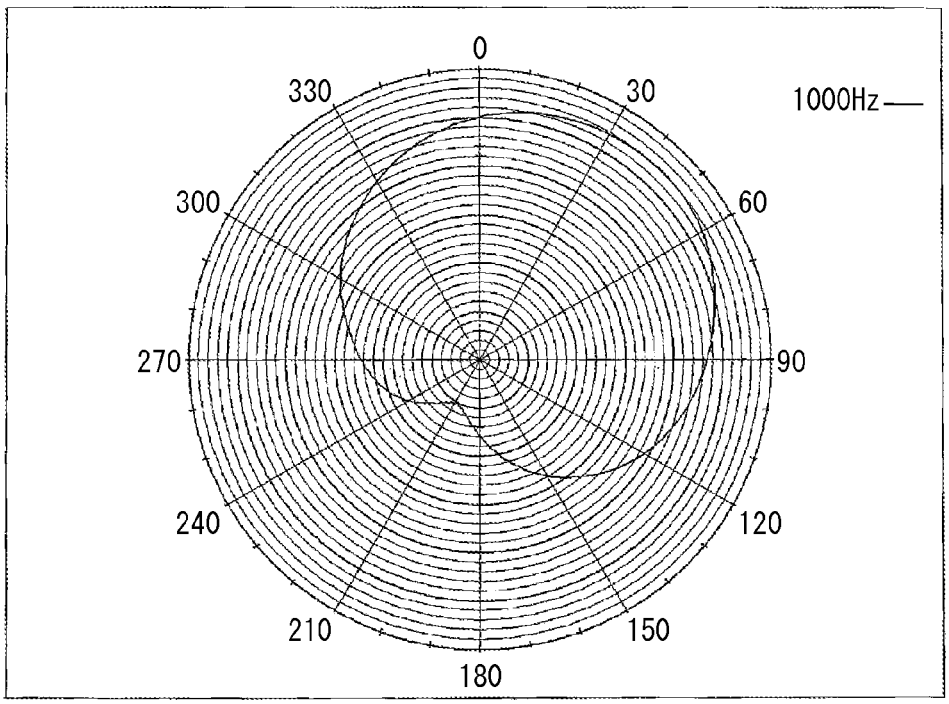
FIG. 7D is a polar pattern of the same.
Figure 8C:
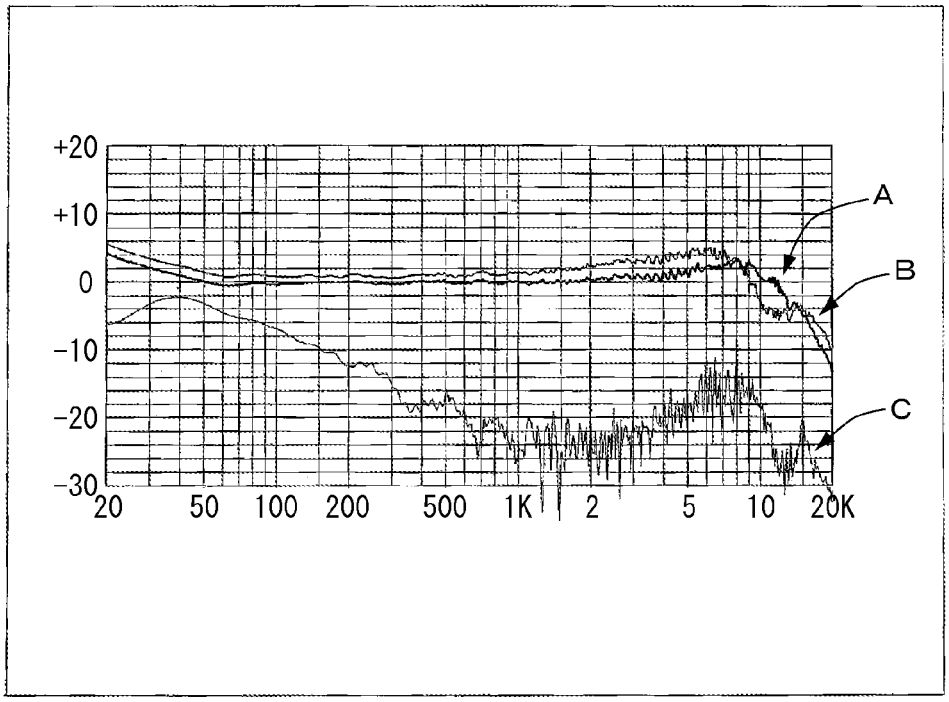
Fig. 8C Prior Art
FIG. 8C is a directional frequency response property chart of the conventional boundary microphone when the elevation angle of the sound collection axis is 30 degrees.
Figure 8D:
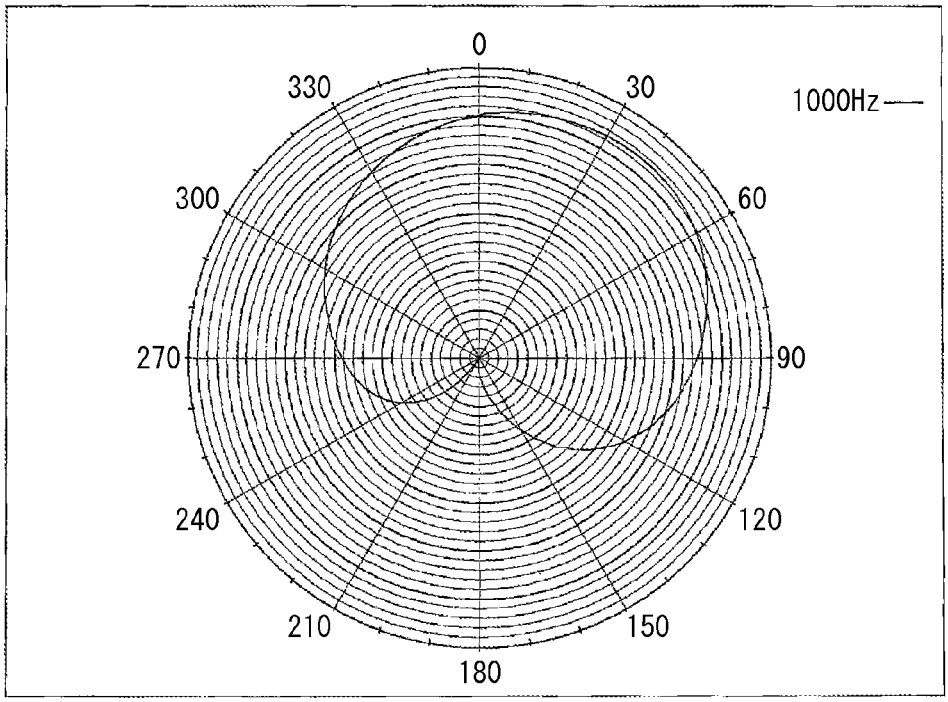
Fig. 8D Prior Art
FIG. 8D is a polar pattern of the same.

In FIGS. 7C and 8C, reference signs A, B, and C indicate properties of 0 degree, 30 degrees, and 210 degrees of the angle to the sound source, respectively, where the elevation angle θ of the sound collection axis D is 30 degrees.

Figure 7E:
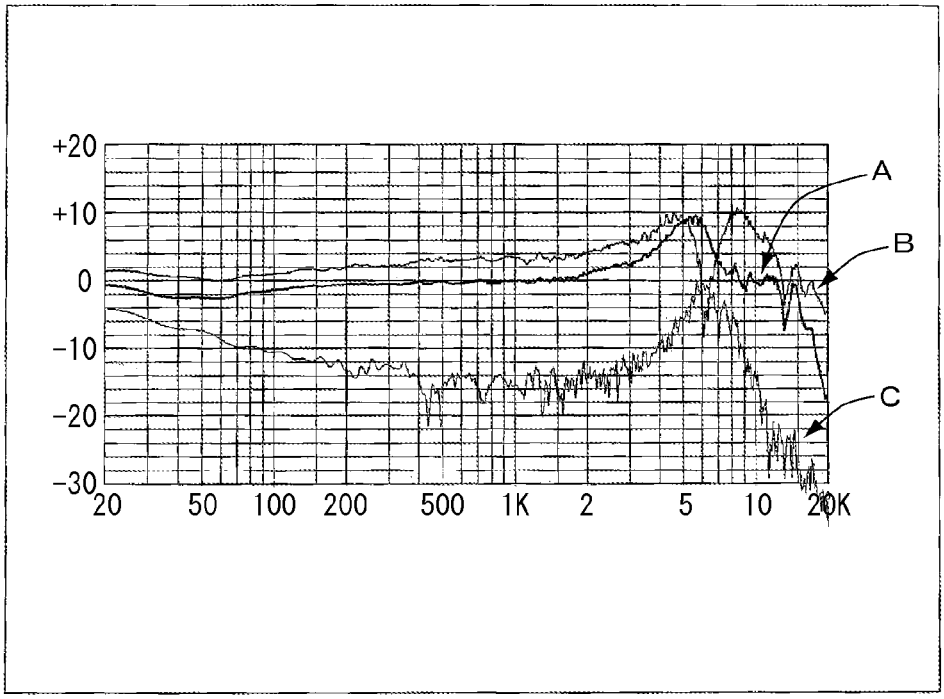
FIG. 7E is a directional frequency response property chart of the boundary microphone when the elevation angle of the sound collection axis is 60 degrees.
Figure 7F:
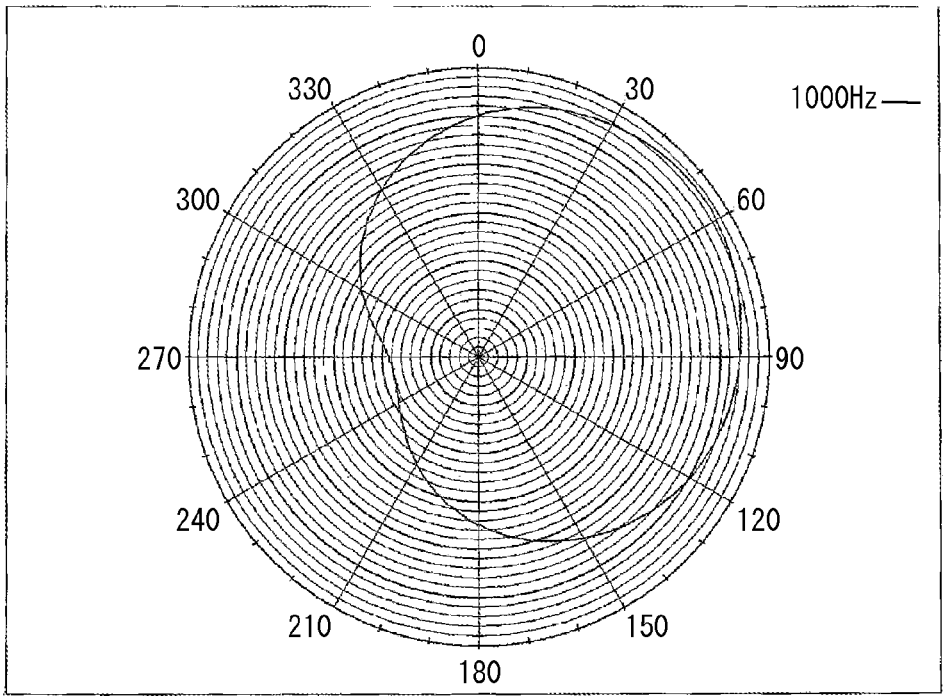
FIG. 7F is a polar pattern of the same.
Figure 8E:
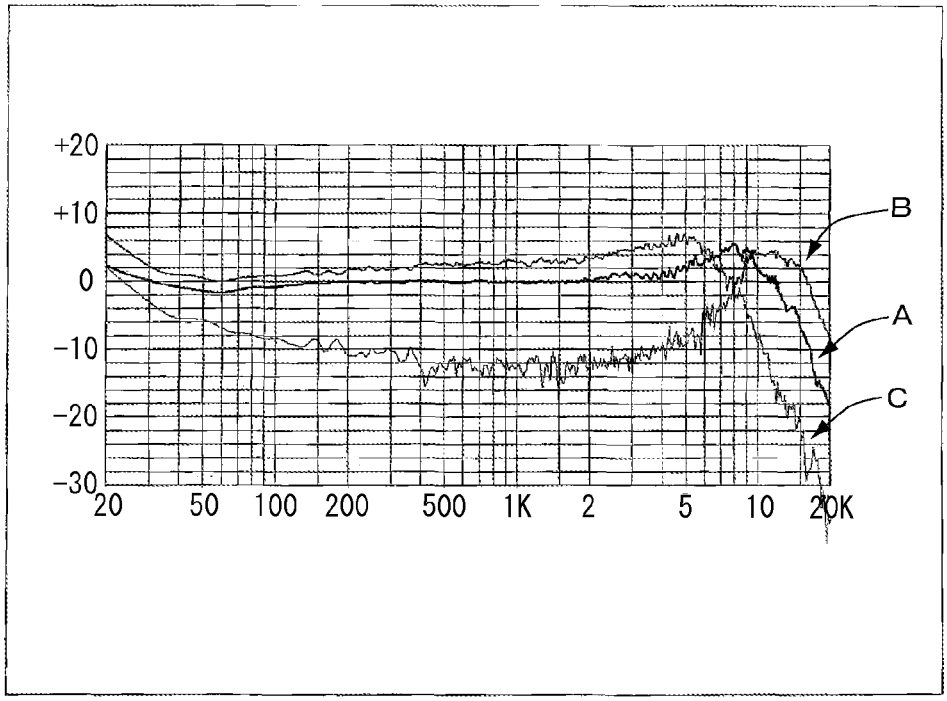
Fig. 8E Prior Art
FIG. 8E is a directional frequency response property chart of the conventional boundary microphone when the elevation angle of the sound collection axis is 60 degrees.
Figure 8F:
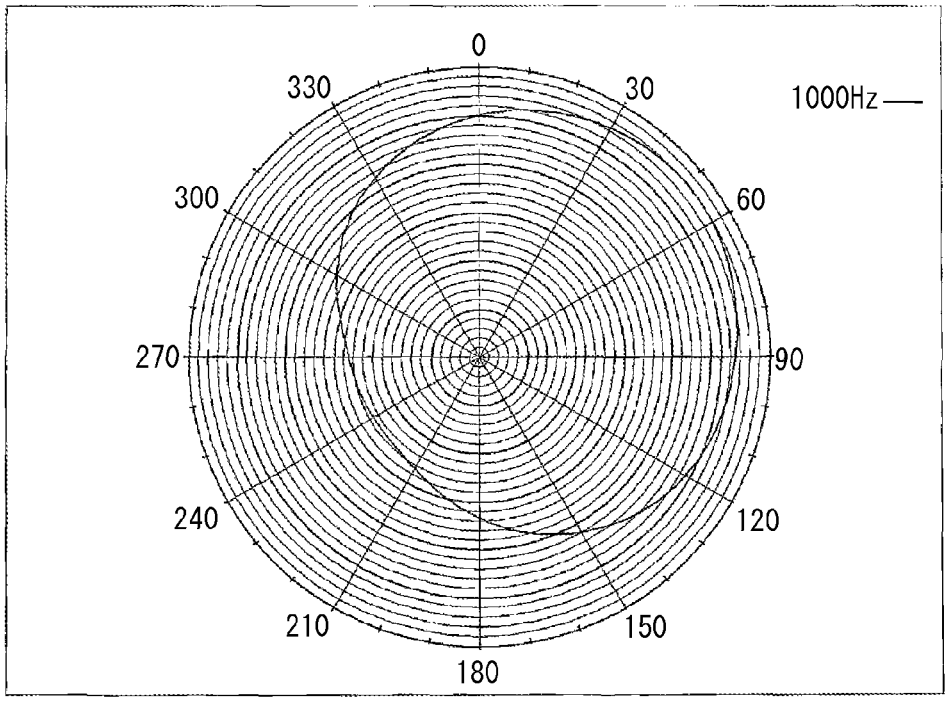
Fig. 8F Prior Art
FIG. 8F is a polar pattern of the same.

In FIGS. 7E and 8E, reference signs A, B, and C indicate properties of 0 degree, 60 degrees, and 240 degrees of the angle to the sound source, respectively, where the elevation angle θ of the sound collection axis D is 60 degrees.

Figure 7G:
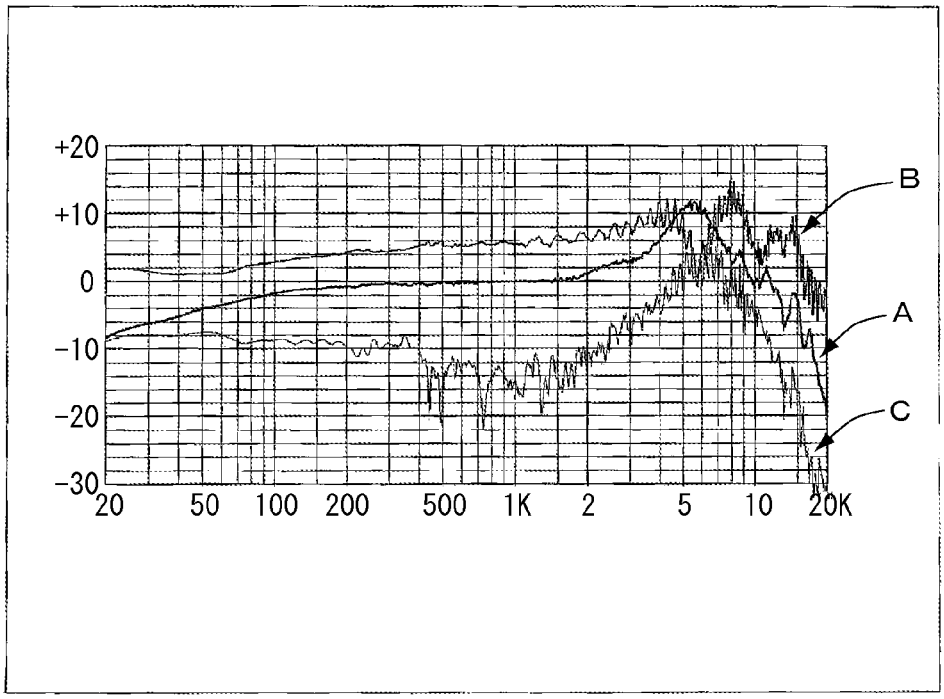
FIG. 7G is a directional frequency response property chart of the boundary microphone when the elevation angle of the sound collection axis is 90 degrees.
Figure 7H:
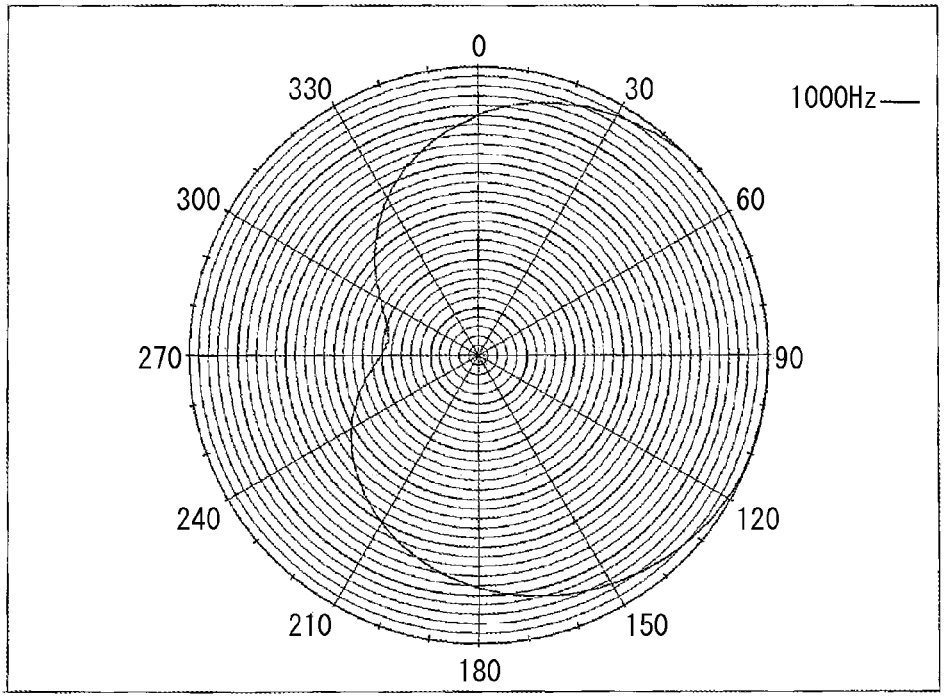
FIG. 7H is a polar pattern of the same.
Figure 8G:
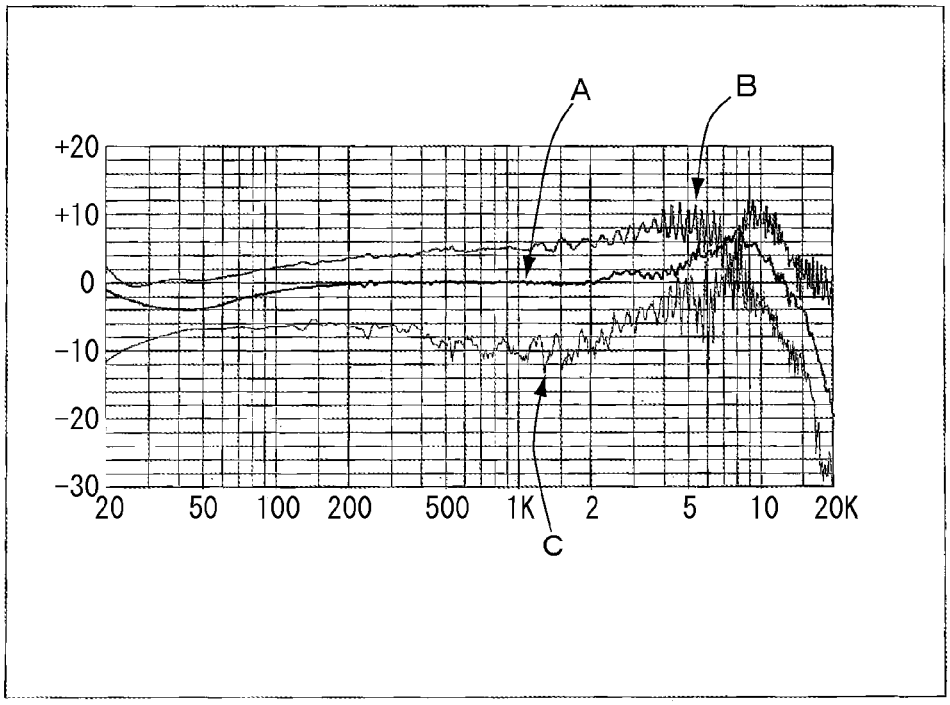
Fig. 8G Prior Art
FIG. 8G is a directional frequency response property chart of the conventional boundary microphone when the elevation angle of the sound collection axis is 90 degrees.
Figure 8H:
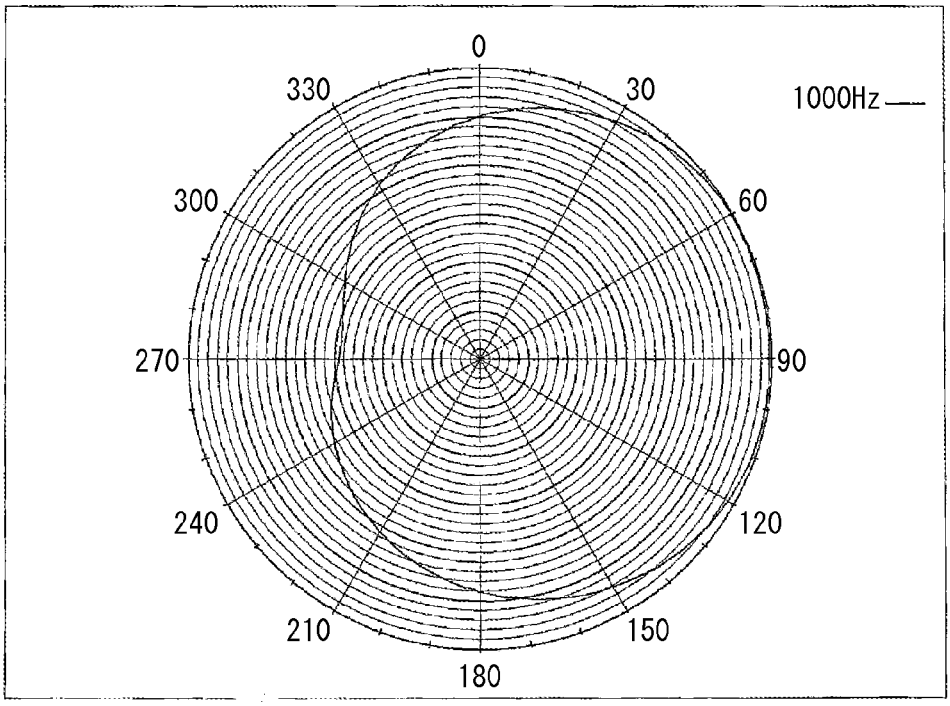
Fig. 8H Prior Art
FIG. 8H is a polar pattern of the same.

In FIGS. 7G and 8G, reference signs A, B, and C indicate properties of 0 degree, 90 degrees, and 270 degrees of the angle to the sound source, respectively, where the elevation angle θ of the sound collection axis D is 90 degree.

The difference in level between 0 degree (property of A) and 180 degrees (property of B) of the angle to the sound source in FIG. 7A is approximately 21 dB, and the difference in level between 30 degrees (property of B) and 210 degrees (property of C) of the angle to the sound source in FIG. 7C is also approximately 21 dB.

The difference in level between 60 degrees (property of B) and 240 degrees (property of C) of the angle to the sound source in FIG. 7E is approximately 19 dB, and the difference in level between 90 degrees (property of B) and 270 degrees (property of C) of the angle to the sound source in FIG. 7G is approximately 21 dB.

These properties explains that the boundary microphone according to the embodiment has a directional property that almost does not change by changing the sound collection axis D.

In contrast, for a conventional boundary microphone, the differences in level in FIGS. 8A, 8C, 8E, and 8G are approximately 30 dB, approximately 27 dB, approximately 16 dB, and approximately 15 dB, respectively, which explain the significant change in directional property caused by changing the sound collection axis D.

The boundary microphone according to the embodiment without the unidirectional microphone can be provided as a boundary microphone adapter. In this case, a user can prepare a unidirectional microphone to configure a boundary microphone providing similar effect.

What is claimed is:

1. A boundary microphone comprising:

a unidirectional microphone unit;

a unit holding member formed in a cylindrical shape having a unit accommodating pocket in a peripheral surface thereof to accommodate the unidirectional microphone unit; and a boundary plate to which the unit holding member is attached so that an axis of a hollow of the unit holding member is parallel with a top face of the boundary plate and the unit holding member rotates about the axis, wherein the unidirectional microphone unit held in the unit holding member includes a front acoustic terminal facing outside of the peripheral surface of the unit holding member, a sound collection axis intersecting the axis of the hollow of the unit holding member, and a rear acoustic terminal communicating with outside at both side ends of the hollow via the hollow of the unit holding member.

2. The boundary microphone according to claim 1, wherein the unit accommodating pocket provided in the unit holding member has a through hole extending from the peripheral surface of the unit holding member toward the axis of the hollow, and an abutment for locking a rear end of the microphone unit to position the microphone unit inserted in the unit accommodating pocket.

3. The boundary microphone according to claim 2, wherein an inner space of the hollow of the unit holding member is partially enlarged to form a bore continuing to the abutment that positions the microphone unit.

4. The boundary microphone according to claim 1, wherein the unit holding member formed in a cylindrical shape is rotatably attached to the boundary plate by a supporting frame member disposed along the peripheral surface of the unit holding member.

5. The boundary microphone according to claim 2, wherein the unit holding member formed in a cylindrical shape is rotatably attached to the boundary plate by a supporting frame member disposed along the peripheral surface of the unit holding member.

6. The boundary microphone according to claim 4, further comprising a supporting part including a pair of the supporting frame members each having a ring shape and attached to both axial ends of the unit holding member along the peripheral surface of the unit holding member, and a pair of base plates for fixing the supporting frame members on the boundary plate, wherein with the axial ends of the unit holding member sandwiched by the pair of supporting frame members which are fixed on the boundary plate using the base plates, the unit holding member is attached so as to rotate above the boundary plate.

7. A boundary microphone adapter comprising:

a unit holding member formed in a cylindrical shape having a unit accommodating pocket in a peripheral surface thereof to accommodate a unidirectional microphone unit; and a boundary plate to which the unit holding member is attached so that an axis of a hollow of the unit holding member is parallel with a top face of the boundary plate and the unit holding member rotates about the axis, wherein when a unidirectional microphone is attached to the unit holding member using the unit accommodating member, a front acoustic terminal is formed to face outside of the peripheral surface of the unit holding member, a sound collection axis intersects the axis of the hollow of the unit holding member, and a rear acoustic terminal communicates with outside at both side ends of the hollow via the hollow of the unit holding member .

8. The boundary microphone adapter according to claim 7, wherein the unit accommodating pocket provided in the unit holding member has a through hole extending from the peripheral surface of the unit holding member toward the axis of the hollow, and an abutment for locking a rear end of the microphone unit to position the microphone unit inserted in the unit accommodating pocket.

* * * * *